US006559744B1

(12) United States Patent
Kirsch

(10) Patent No.: US 6,559,744 B1
(45) Date of Patent: May 6, 2003

(54) TWIN RELAY

(75) Inventor: Eberhard Kirsch, Wehingen (DE)

(73) Assignee: Hengstler GmbH, Aldingen (DE)

( * ) Notice: Subject to any disclaimer, the term of this patent is extended or adjusted under 35 U.S.C. 154(b) by 0 days.

(21) Appl. No.: 09/673,769

(22) PCT Filed: Apr. 4, 1999

(86) PCT No.: PCT/EP99/02508

§ 371 (c)(1),
(2), (4) Date: Nov. 7, 2000

(87) PCT Pub. No.: WO99/54905

PCT Pub. Date: Oct. 28, 1999

(30) Foreign Application Priority Data

Apr. 17, 1998 (DE) ..... 198 16 878

(51) Int. Cl.[7] ..... H01H 47/16

(52) U.S. Cl. ..... 335/78; 335/80; 335/127; 335/128; 335/159; 335/162

(58) Field of Search ..... 335/78–86, 127–131, 335/133–137, 159–163

(56) References Cited

U.S. PATENT DOCUMENTS

| | | | | |
|---|---|---|---|---|
| 3,581,157 A | * | 5/1971 | Hall | 335/120 |
| 4,959,627 A | | 9/1990 | Iizumi et al. | 335/106 |
| 5,673,012 A | | 9/1997 | Stadler et al. | 335/78 |
| 5,801,608 A | | 9/1998 | Mader | 335/128 |

FOREIGN PATENT DOCUMENTS

| | | |
|---|---|---|
| DE | 15 39 830 | 12/1969 |
| DE | 38 34 283 | 4/1990 |
| DE | 38 43 359 | 9/1990 |
| DE | 195 20 220 | 11/1996 |
| DE | 196 06 883 | 4/1997 |
| GB | 576623 | 4/1946 |

* cited by examiner

*Primary Examiner*—Ramon M. Barrera
(74) *Attorney, Agent, or Firm*—Baker & Daniels

(57) ABSTRACT

The invention relates to a twin relay with at least two drive mechanisms which are separate from each other. The drive mechanisms each act on designated contact springs and both act on a single contact assembly.

17 Claims, 6 Drawing Sheets

TWIN RELAY

The invention relates to a twin relay according to the generic term of patent claim 1.

It is a known practice, especially in communications technology, to provide so-called twin relays which consist of two relays, separate from each other, which have, for example, a common yoke.

The purpose of this measure was that in certain problem situations of communications technology it was necessary always to use two relays which, however, were driven separately from one another. For reasons of space then such relays were constructed with a common yoke; they were, however, functionally entirely independent.

In another mode of execution of a twin relay (backup relay) two independent relays are mounted on a common mounting base, and the common element connecting the two relays is a mechanical locking of the two armatures.

By reason of the mechanical locking between the two armatures of these relays arranged parallel next to each other it is provided, for example, that in each case only one of the two relays is in working position, while the other relay, for example, is locked in the rest position.

Characteristic for this relay was also the separate drive and the completely separate arrangement of the contact spring sets with connections. Such backup relays have, therefore, a relatively high space requirement, because the contact spring sets and their connections are led out altogether separately and have to be driven correspondingly.

Underlying the invention, therefore, is the problem of further developing a twin relay of the type mentioned at the outset, in such manner that the execution as a twin relay occurs with substantially less space requirement and substantially less use of material.

For the solution of the problem posed, the invention is characterized by the technical teaching of claim 1.

An essential feature of the invention is that the twin relay has at least two drives separate from each other, which drives act in each case on an allocated contact spring, and that both drives operate in common or at least partially in common on a single contact set.

With the present invention, therefore, there is achieved the essential advantage that in one and the same relay housing now two relays are arranged, to which in each case there is allocated a drive that is its own and is independent, in which, however, the contact sets are united with one another.

Relays with compulsorily guided contacts are used in a large number of applications, which through the utilization of the forcibly guided contacts as a rule have circuitry features in common. For the safer conversion of the self-monitoring and for the establishment of redundance and double-channel character, the relays necessary for the clearing/switch-off of the monitored circuits are always required twofold. In principle this is dependent on the manner in which the drive of these two relays is executed. This can, of course, likewise take place by means of relays, but also by an electronic system or by a combination of electronic system and relays.

Since two output relays must always be present, the question arises of the extent to which it is technically and economically purposeful to combine these into a "twin relay". In such a construction the switchings otherwise to be carried out externally could in a simple manner be performed already within the relay. The tying into a circuit and the wiring of such a combination, for example, on a conductor plate, would therewith be simplified. Creepage and air distances could be enlarged, or conductor paths could be made wider. There, no increased space requirement would arise. Here there is in mind especially a horizontal relay; a flat construction form which is especially suited for installation in narrow housings, for example a housing width of 22.5 mm.

Functionally such a unit can present all the elements for so-called extension modules.

The contacts of the two relays can be combined. The individual contact there no longer consists of an active and of a passive spring, but of two active contact springs which are moved in each case by one drive.

The advantages of the present invention are to be seen in the following features:

- Volume reduction with respect to two individual relays;
- Space gain on the conductor plate, which can be used to increase the conductor cross sections or to accommodate other components;
- Thermal unburdening of the conductor plate, the possibility of making conductor paths wider;
- Lower assembly costs for the subassembly (end stage= exploitation apparatus);
- Construction as a complete functional unit (in respect to the electro-mechanical functional part), fitting for suitable drives, such as, for example, photoelectric barriers, light curtains, two-hand trip gears and others;
- With a combining of the contacts there is yielded a clear saving in materials;
- Through the clear allocation of the usability of the contacts a special constructive formation can be advantageous;
- Consistent marking (stamping) of the required insulation;

If there is included in such a consideration also the general development of control technology, then such a relay combination would have good possibilities of use in the future. The trend in control technology is in the direction of decentralization of the functions. This holds true especially for installations and large machines. The connecting of these decentralized functions occurs by means of a bus.

Therewith it is simultaneously necessary to implement certain safety functions decentrally. Moreover, in such a decentralization the sturdiness in respect to the secure electrical separation, and the EMV, gain in their significance.

Proceeding from a structural height with a max. of 15 mm and an external geometry of ca. 65 mm×75 mm, a 2×6-contact (6-contact) combination should be accommodated.

The structural height is formed by 2 planes.

On the half facing the connection side, for example, the drive systems are executed as poled displacement armatures. Such displacement armatures are known.

In the second plane the contact set is accommodated.

In principle there are present such properties as compulsory guidance, error tolerance, isolation, internal actuation, "beam"-spring combination, etc.

The distribution of the connections on the underside of the relay is optimal for the user when the connections are distributed in the region of the outer edges. In this case the rest of the space covered by the relay is available for other components. If the connections are arranged centrally under the relay, the area for the conductor paths is needed for these connections.

The active springs of the twins are constructed in one piece. It is also conceivable that the passive contact parts are in one piece. Therewith only the passive contact springs per connection are still led to the outside; the switching in series of the two contacts takes place internally. This relates first of all to the closers (closing elements) and openers which are available later for external use.

The supporting plastic element of this relay could be constructed in cross section in such manner that the placement of the drives occurs on the one surface side and the placement of the contacts on the other surface side. The covering on the connection side and on the contact side would be made, in each case, by an element which could be a cover or also an enclosing hood. The cover or hood can also have dividing walls which serves for the chambering off or for a laminated solid insulation.

The surface that lies opposite the connection side can be executed so that it simultaneously represents the outer surface of a 22.5 mm wide housing. For the better fitting in a covering frame the surrounding edge can be provided with a corresponding surrounding depression.

Over the position of the contact set operator there can be placed over the narrow side, an optical feature for the recognition of the actual position of the contact set (with a sufficiently translucent covering).

The inventive object of the present invention is yielded not only from the object of the individual patent claims, but also from the combination of the individual patent claims among one another.

All the data and features disclosed in the documents, inclusive of the abstract, in particular the spatial execution represented in the drawings, are claimed as essential to the invention insofar as they are novel with respect to the state of the art, individually or in combination.

In the following the invention is explained in detail with the aid of a drawing representing several forms of execution. Here from the drawing and its description there appear further features and advantages of the invention, essential to the invention.

In the drawings:

FIG. 1: A schematically drawn side view of a compulsorily guided contact (representation of the closer only);

FIG. 2: In schematic representation, the execution of a twin relay with the passive spring as outer connection;

FIG. 3: In schematic representation, the face view of a relay according to FIG. 2;

FIG. 4: A form of execution, modified with respect to FIG. 2, of a twin relay in which each individual contact consists of two active contact springs;

FIG. 5: A further schematically represented form of execution, which in comparison to FIG. 2, only has other outer connections;

FIG. 6: In schematic representation, the execution of a third form of execution.

FIG. 7: In schematic representation, the execution of a fourth form of execution.

With the aid of FIG. 1 there are represented the basic relations in a relay contact. In the closer represented in FIG. 1 it is evident that in a spring bracket 1 there are clamped the passive contact spring 2 and the active contact spring 6. The respective springs 2, 6 are led out by means of connections 3, 7 and are contactable there.

The passive contact spring 2 has a front contact piece 5 and lies against a housing-fast stop 4.

The active contact spring 6 is actuated by an actuator 8. By the expression "internal actuation" it is meant that the actuator 8, with its pushers 11 which receive between them and guide the active contact spring 6, is actuated in the interspace between the contact piece 12 and the clamping place in the spring block 1.

The actuation occurs in such manner that the actuator 8 moves in arrow direction 9, the active contact spring 6 in the direction of a closing onto the passive contact 2, while in opposite direction—arrow direction 10—the contact is opened.

The invention is not restricted to the feature that the active contact spring 6 is carried along between two pushers (mitnehmern) 11 (in FIG. 1 of the drawing the one pusher is designated by 11*a*); it also suffices to separate the pushers 11 spatially from each other, or also to make them movable independently from each other.

In FIG. 2 such a twin relay 16 is represented, which consists of two partial relays 13, 14. The two partial relays 13, 14 are electrically separated from each other by an intermediate insulating partition 15.

What is characteristic of the invention now is that certain parts of the contact set of these two partial relays 13, 14 are present in common, and that to each partial relay 13, 14 there is allocated a common active contact spring 6 (for instance in the example of execution shown according to FIG. 2).

FIG. 2 shows here that each partial relay 13, 14 has altogether four contacts, in which the individual contact can be constructed either as an opener, as a closer, or as a change-over contact.

Likewise it is a matter of indifference how many contacts ate arranged in a partial relay 13, 14, because the number is arbitrary. There can, therefore, always be only one contact present; but there can also be present a plurality of contacts arranged one over another, as is recognizable in FIG. 2 with the aid of four separate contacts.

In FIG. 2 it is represented that each contact is arranged in a chamber 20, 21, 22, 23 of its own, wherein it is recognizable that the parts arranged in the right hand partial relay 14 are provided with an apostrophe and belong opposite the same parts on the left side which belong to the partial relay 13.

Obviously the invention is not restricted to the concept that such contacts are arranged in chambers 20–23 electrically insulated from one another. The chambers 20–23, namely, are separated from one another by corresponding horizontally running partitions 17. To this, however, the invention is not restricted. Such horizontally running partitions 17 can also be omitted.

In correspondence to the explanation for FIG. 1 given earlier, it is further stated that the actuator 8 consists essentially of two parts; this, however is likewise not necessary for the solution. It suffices here to provided in each case only one actuator 19, which engages in each case on the one side of the active contact spring 6, 6'.

The oppositely lying pusher is designated in the following as compulsory guide 18 and has as its only purpose to prevent the possibility that opener and closer can be closed simultaneously.

What is important now is that the entire drive for the partial relay 13, which is designated in the following as partial drive 24, is mechanically separate and is fully autonomous from the partial drive 25 for the right hand partial relay 14.

I.e., therefore, the entire drive system, of either the partial drive 24 or of the partial drive 25, is in each case driven and actuated separately from the other one, in the arrow directions 26, 27.

FIG. 3 shows schematically that this drive system consisting of the partial drives 24, 25 is in a plane below the partial relays 13, 14. I.e, therefore, the contact plane is arranged above the level for the partial drives 24, 25. This leads to a considerably smaller space requirement, because the entire drive system is arranged underneath the contact system according to FIG. 2.

Obviously it is provided in another embodiment of the invention that the planes are interchanged. In this arrangement, not graphically represented, the plane for the drives 24, 25 then is arranged above the plane for the contact sets of the partial relays 13, 14.

Such a drive system could consist in that two cutout blade relays are present, and there could also be present a displacement type armature system. In both drives it is characteristic that both have in each case a separate relay coil, which relay coil in each case acts over a separate yoke on an allocated armature and moves the latter.

Each armature acts, therefore, in the arrow directions 26, 27 shown in the drawing on the allocated partial drive system 24, 25 of the respective partial relay 13, 14.

With the aid of the example of execution in FIG. 2 there can now be explained a practical case of application.

Each one of the lower chambers 20, 20' of the respective partial relay 13, 14 are constructed in each case as openers. Characteristic for these two openers is the feature that the active contact spring 6 is through-connected, and consequently it electrically connects the two openers with each other, so that these two contacts are electrically connected in series.

As soon as one of the two openers opens, for example the opener in partial relay 13, the circuit between the connections 3, 3' is interrupted. From this, therefore, there is yielded the circuiting in series of these two contacts.

In an analogous manner this holds also for the closer shown in the chambers 23, 23', because the series circuit from the two closers is closed only when the active contact spring of both autonomous drive systems is correspondingly moved upward in arrow direction 26, 27, in order to activate the closer contacts.

From the examples of execution shown it is perceived that the relay always consists of a series circuit of contacts, in which this series circuit, however, always shares an active contact spring. By reason of the electric through-connection of the active contact springs it is now no longer necessary to lead these active contact springs to the outside over separate connections, and to connect them with one another over allocated connections. The connections are directly brought about in the relay already, therefore, without contacting requirement, without connecting lines and without corresponding conductor paths.

In FIG. 4 it is represented, as a further example of execution, that each individual contact consists of two active contact springs, which are moved in each case separately by the two drives (partial drives 24, 25). As FIG. 4 shows, the movement of the two partial drives 24, 25 is in opposite direction, because, after all, the actuation of the contact springs 6, 6', active in each case, always occurs in opposite directions. This occurs through the fact that on the one contact spring 6 the actuator 19 lies on the one side, while on the other contact spring 6' the actuator 19 lies on the other side.

Here it is again perceptible that the two active contact springs 6, 6' that are actuatable separately from one another form, to be sure, a single contact 28, which is constructed as opener, but that nevertheless there is present a circuit of the two contacts in series in the sense of the previous FIG. 2.

The opener contact 28 is opened as soon as one of the two contact springs 6 or 6' is acted upon by the allocated partial drive 24 or 25, respectively.

Analogously this holds also for the contact 29 (closer) in the chamber 23, 23', which is always closed only when both partial drives 24, 25 are actuated, so that the contact 29 is hereby closed.

The respective active contact spring 6, 6' has the allocated external connection 3, 3', which is led out of the relay.

Figure 7:
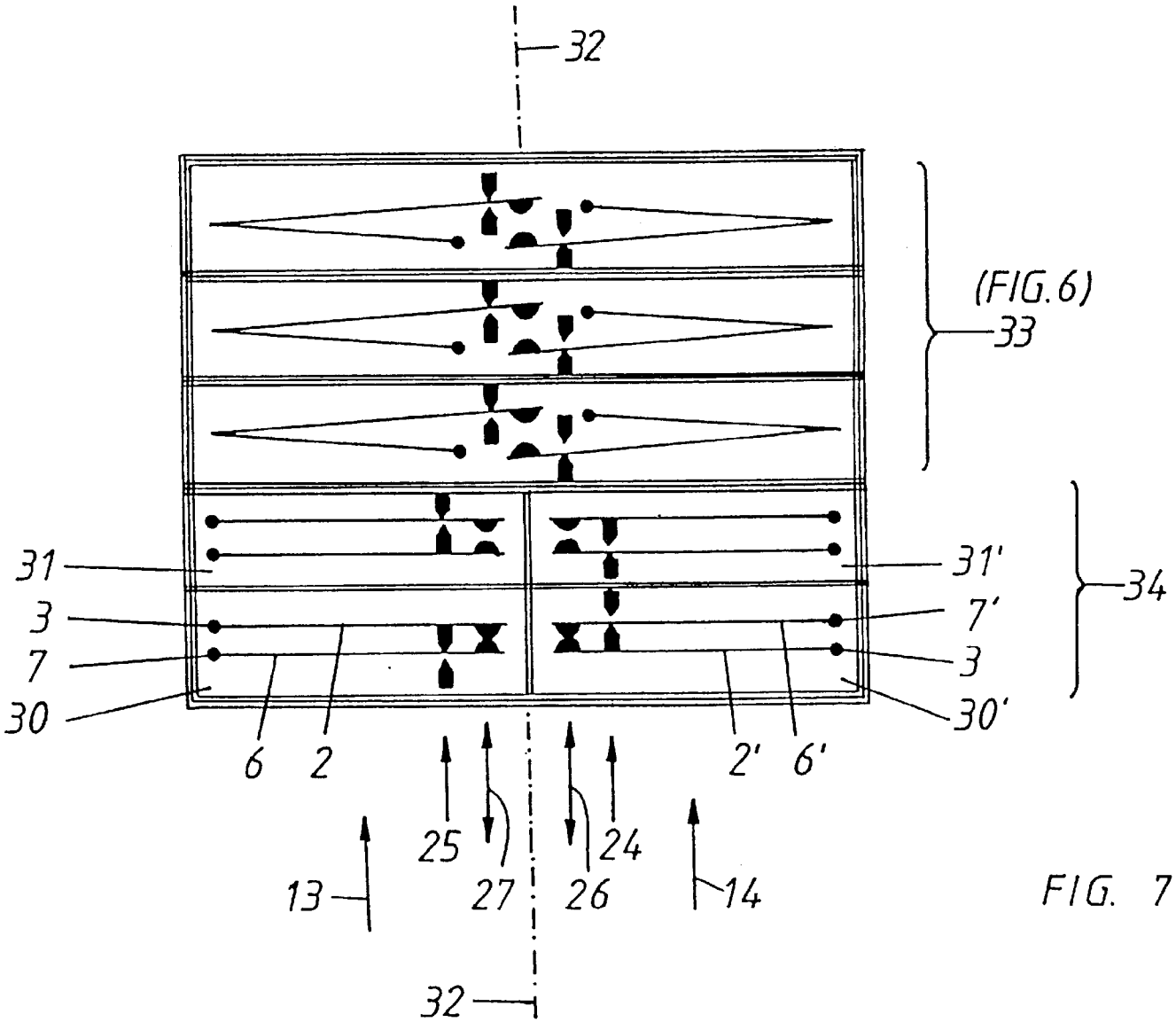

FIG. 7 shows that the respective partial drive systems 24, 25 of the partial relays 13, 14 also do not have to be arranged in alignment one over another, but that the partial drive systems are arranged throughout offset to one another. What is important in this example of execution is again that the drive system 24 is always actuated in the arrow direction 26, while the drive system 25 of the partial relay 13 is actuated in the arrow directions 27 separately from the other partial drive system.

Figure 6:
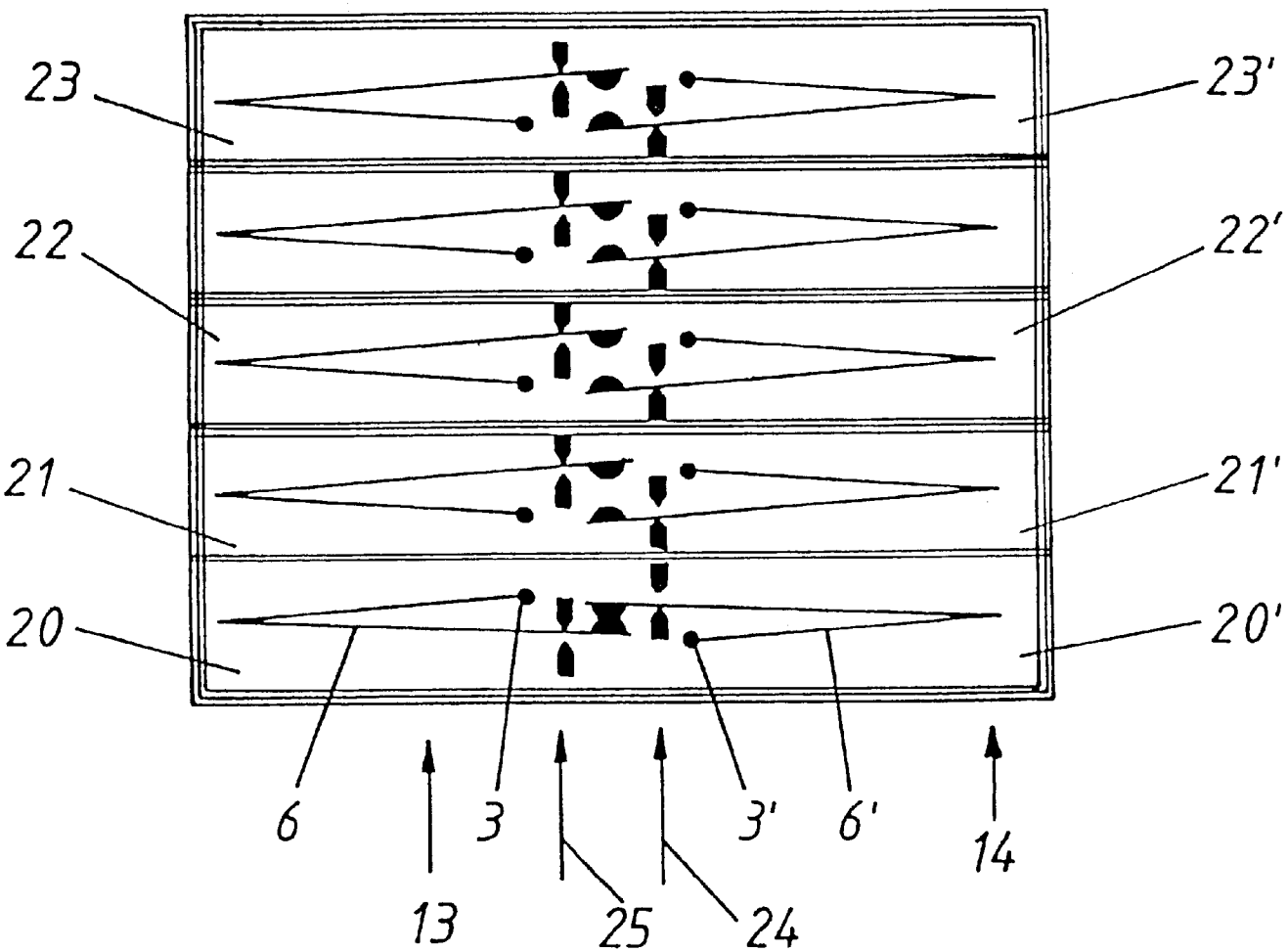
FIG. 6 is a variant of FIG. 4, in which the same explanations hold as were given for FIG. 4. What is different is merely that the respective connection 3, 3' of the respective active contact spring 6, 6' is now not led out on the relay, but is constructed internally lying.

Further, FIG. 7 shows that the upper part of the respective partial relay 13, 14 consists of an arrangement such as was already described with the aid of FIG. 6, while the lower part, consisting of the chambers 30, 31 and 30', 31' respectively shows that both connections 3, 7 and 3', 7' of the active contact spring and also the passive contact spring are led out. What is characteristic in this form of execution, therefore, is that the two partial relays 14, 13 consist of relay systems arranged one over the other, in which the two relay systems have, in each case, a common partial drive system 24, 25.

The separation between the two relay systems occurs in the direction to the left and to the right of the longitudinal intermediate axis 32 shown in the drawing.

In the upper part 33 of this relay, therefore, the contacts are driven in common, with in each case two separate partial drive systems 24, 25, while in the lower part 34 the contacts are driven individually, i.e. separately from one another.

Obviously the invention is not restricted to the combination of the parts 33, 34 represented here. The invention relates to all the forms of execution previously represented, which can now be arranged modularly lying one over another, as was shown with the aid of the superposed parts 33, 34, wherein each part 33, 34 is divided with respect to the longitudinal intermediate axis 32 and each part (left side and right side) of the respective part, 33, 34, has a partial drive system 24, 25 of its own.

Figure 1:
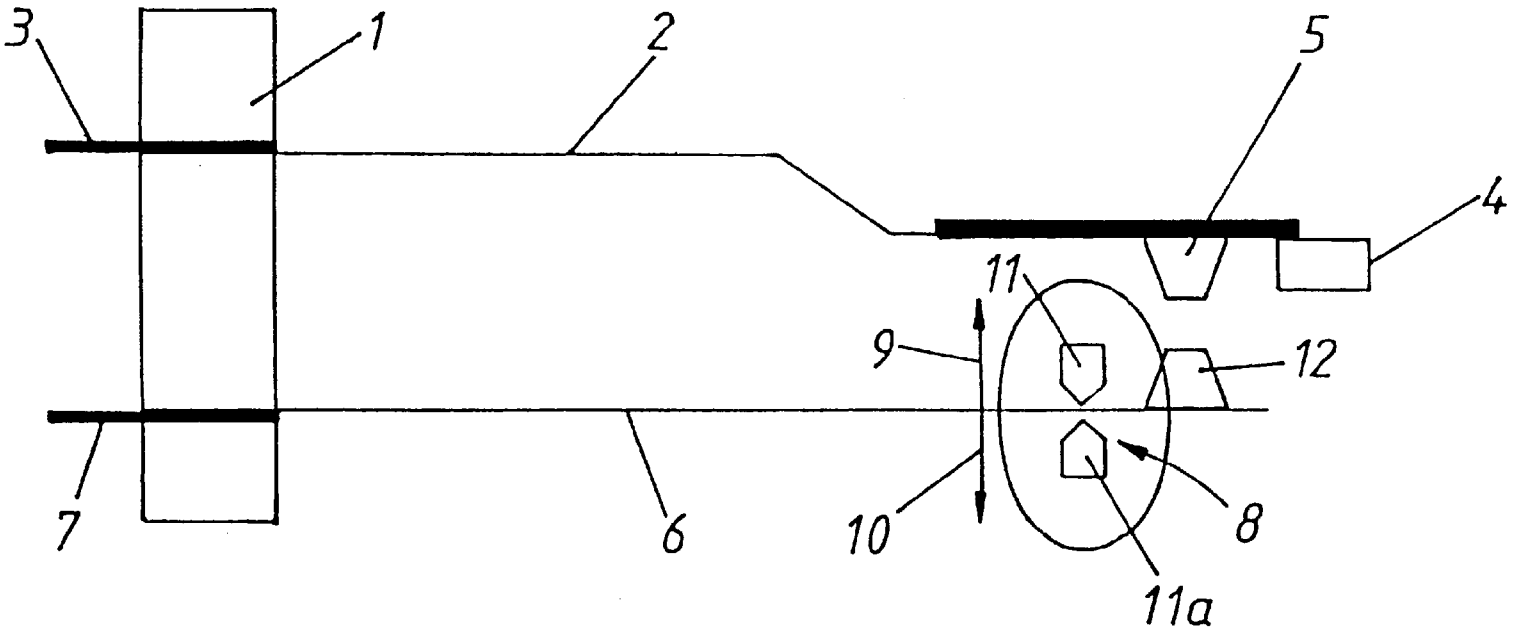
Figure 2:
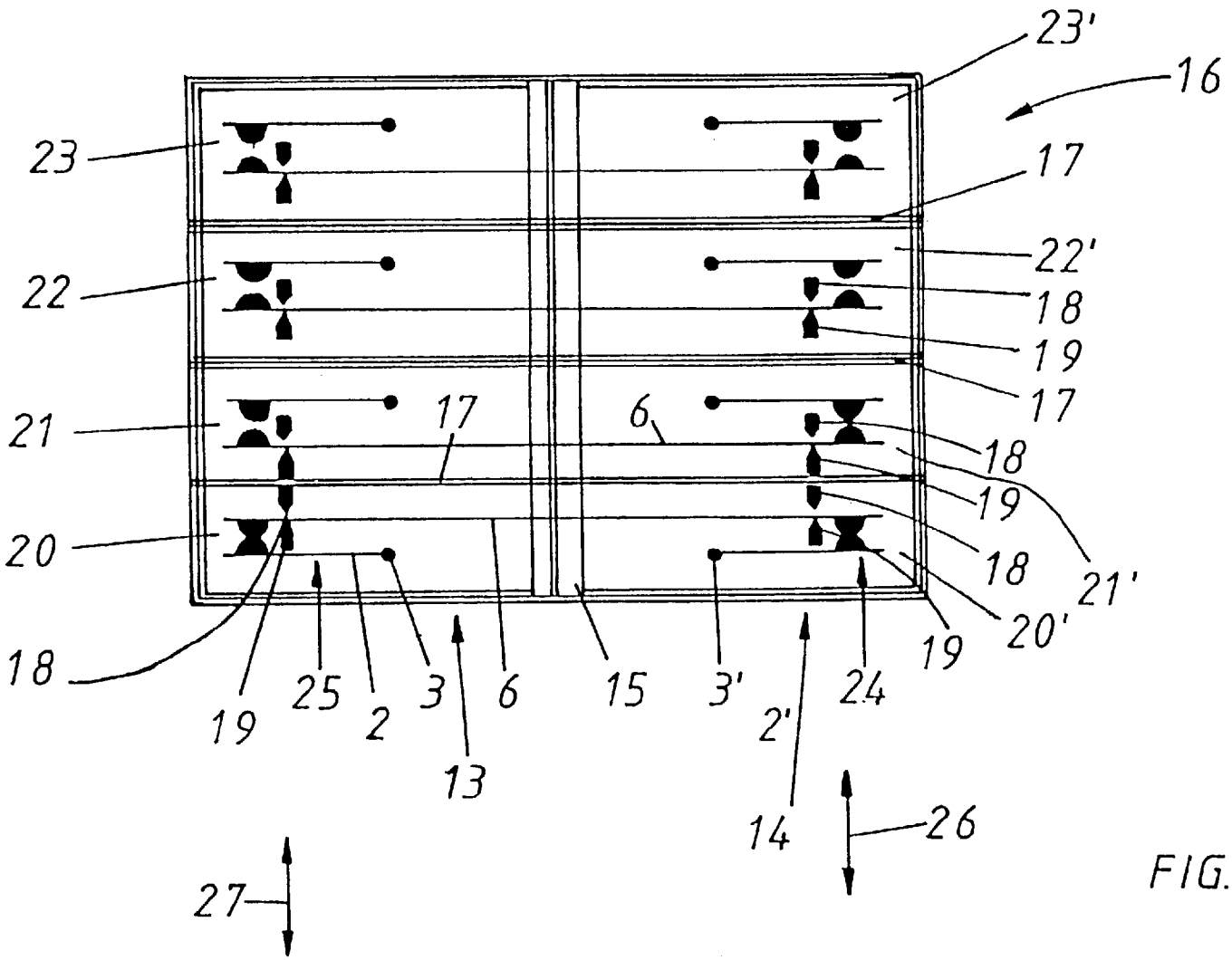
Figure 3:
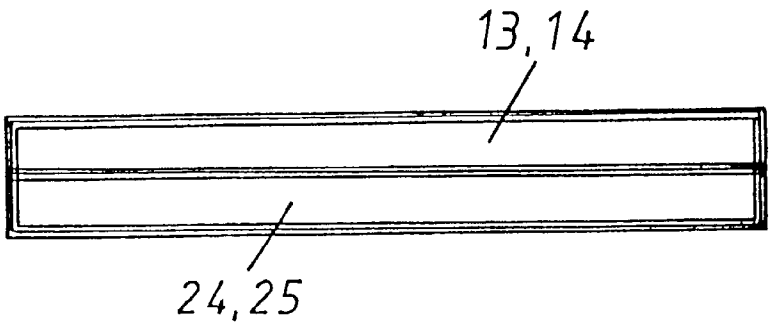
Figure 4:
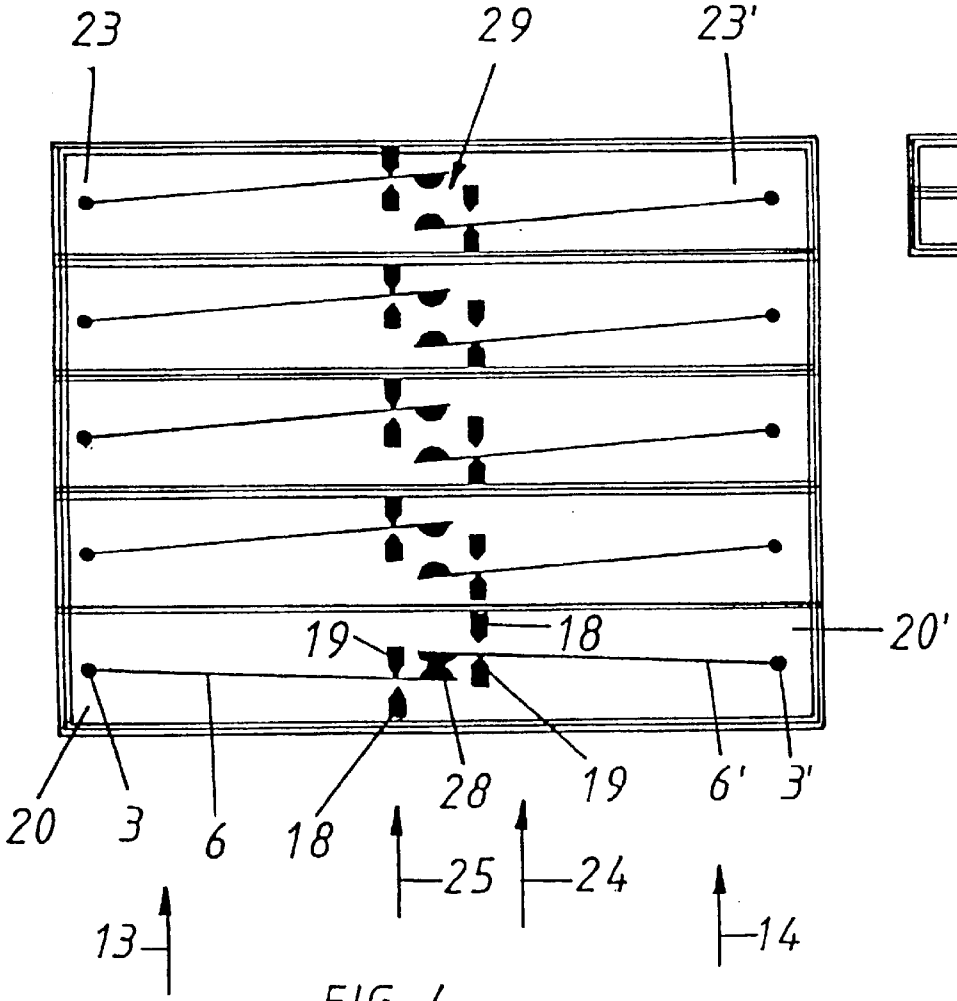
Figure 5:
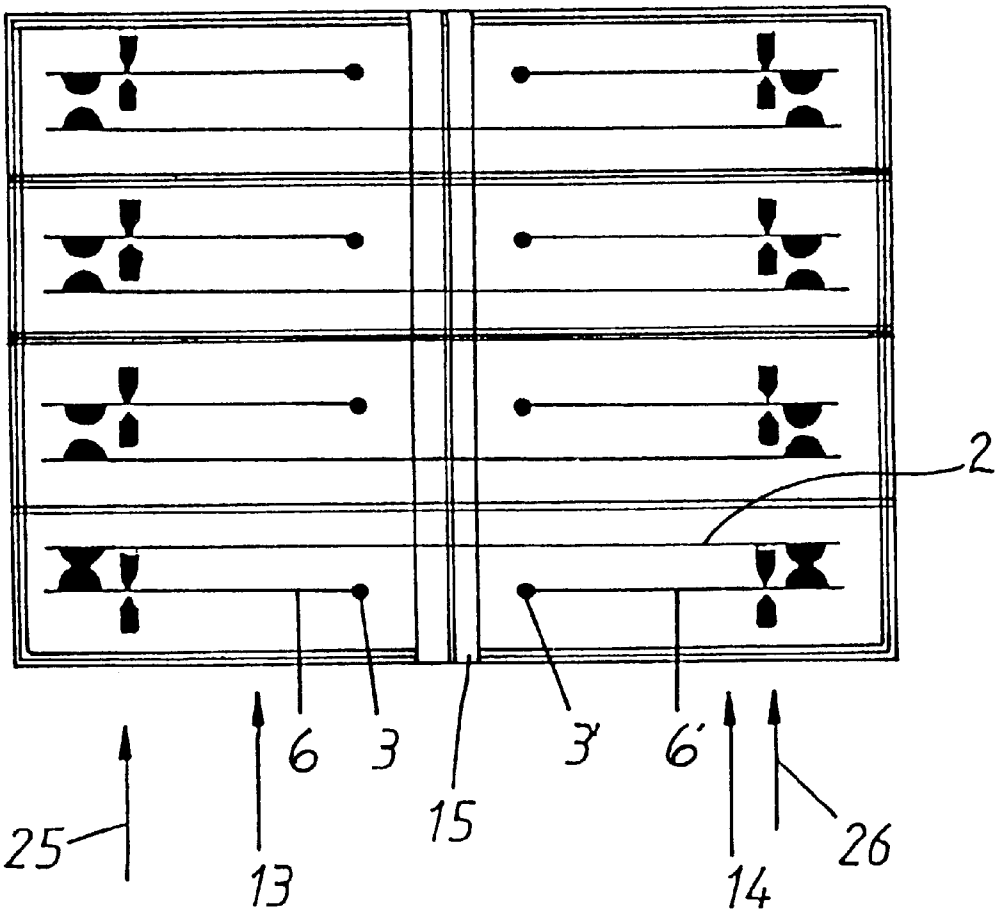
FIG. 5 shows the same relations as in FIG. 2; it is only perceptible that the internally lying connections 3, 3' of the respective passive contact springs are differently placed; i.e. they are led out at another point in the spring block.

What is important is that to the two parts 33, 34 modularly arranged one over another, there is allocated in each case a partial drive system, 24, 25 of its own. It is important that this modular construction, as it is composed by the lodging one upon another of two such parts 33, 34, can also be executed multiply, so that, therefore, also other contact constellations can be arranged as shown for example, in FIG. 4, FIG. 5, FIG. 6, disposed one over the other in the form of this modular structure.

Characteristic for all the modes of constructions is the feature that in each case with respect to the longitudinal intermediate axis 32 there is formed a left hand partial relay 13 and a right hand partial relay 14, and that to each partial relay 13, 14 there is allocated a separate drive system, which is represented in the drawings as partial drive 24 and 25.

FIG. 7 shows, as a deviation from the examples of execution previously shown, that both the active contact spring and also the passive spring are led out in each case with connections 3, 7 and 3', 7', respectively.

The contacts needed for the internal use must be considered separately. Here it is a matter in each case of 1 opener and 1 closer.

The opener there is cut into the monitoring circuit for the start of the arrangement. The closer is used for the locking. These contacts have a substantially lower load to carry than those available for the external use. Here there is present a potential for reducing the required volume. A corresponding statement holds also for the insulating of the drive.

The question as to whether a connection of the internally usable closer should already be joined with a coil end is different from case to case.

The advantage of the twin relay represented here is, therefore, that with the least space requirement a simpler production is ensured, because externally lying circuits are eliminated. From this the user has a great benefit, because wiring errors are avoided from the outset and space is given, on a possibly present conductor plate, for other applications and connection paths.

For the user there is yielded the substantial advantage that in actual fact in a single housing two partial relays are arranged which are controllable separately from one another, but are to be regarded as one piece in the storing and processing, which considerably simplifies handling.

Drawing Legends

1 Spring block
2 Passive contact spring
3 Connection 3'
4 Stop
5 Contact piece
6 Active contact spring 6'
7 Connection
8 Actuator
9 Arrow direction
10 Arrow direction
11 Pusher 11*a*
12 Contact piece
13 Partial relay
14 Partial relay
15 Partition
16 Twin relay
17 Partition
18 Compulsory guide
19 Actuator
20 Chamber 20'
21 Chamber 21'
22 Chamber 22'
23 Chamber 23'
24 Partial drive
25 Partial drive
26 Arrow direction
27 Arrow direction
28 Contact (opener)
29 Contact (closer)
30 Chamber 30'
31 Chamber 31'
32 Longitudinal intermediate axis
33 Part
34 Part

What is claimed is:

1. A twin relay including two partial relays which have at least two partial drives separate from one another, which partial drives each act on at least one allocated active contact spring, characterized in that on actuation of the two partial drives, at least one corresponding pair of active contact springs of the two partial relays together form an electrical working contact without additional passive contact springs.

2. The twin relay according to claim 1, characterized in that each contact spring pair is disposed within a surrounding chamber, with partitions insulating adjacent chambers from one another.

3. The twin relay according to claim 2, characterized in that the partial drives are disposed on one side of the twin relay, and the electrical contacts are disposed on the other side of the twin relay.

4. The twin relay according to claim 2, characterized in that the position of at least one contact spring pair is optically indicated.

5. The twin relay according to claim 1, characterized in that the partial drives are disposed on one side of the twin relay, and the electrical contacts are disposed on the other side of the twin relay.

6. The twin relay according to claim 5, characterized in that the position of at least one contact spring pair is optically indicated.

7. The twin relay according to claim 1, characterized in that the position of at least one contact spring pair is optically indicated.

8. A twin relay including two partial relays having at least two partial drives separated from one another, which partial drives each act on at least one active contact spring to form at least one electrical working contact in the form of spring pair with at least one respective allocated passive spring on actuation of the two partial drives, each respective spring pair being connected in series to one another in the circuit, characterized in that corresponding pairs of active contact springs are formed as one piece which is disposed substantially parallel to the passive contact springs.

9. The twin relay according to claim 8, characterized in that each contact spring pair is disposed within a surrounding chamber with partitions insulating adjacent chambers from one another.

10. The twin relay according to claim 9, characterized in that the partial drives are disposed on one side of the twin relay, and the electrical contacts are disposed on the other side of the twin relay.

11. The twin relay according to claim 9, characterized in that the position of at least one contact spring pair is optically indicated.

12. The twin relay according to claim 8, characterized in that the partial drives are disposed on one side of the twin relay, and the electrical contacts are disposed on the other side of the twin relay.

13. The twin relay according to claim 8, characterized in that the position of at least one contact spring pair is optically indicated.

14. A twin relay including two partial relays which have at least two partial drives separated from one another, which partial drives each act on at least one allocated active contact spring each having an allocated passive contact spring which, on actuation of the two partial drives, form an electrical working contact in the form of a spring pair, wherein the contact spring pairs are connected in series to one another in the circuit, characterized in that corresponding pairs of the passive contact springs are constructed as one piece which is disposed substantially parallel to the active contact springs.

15. The twin relay according to claim 14, characterized in that each contact spring pair is disposed within a surrounding chamber with partitions insulating adjacent chambers from one another.

16. The twin relay according to claim 14, characterized in that the partial drives are disposed on one side of the twin relay, and the electrical contacts are disposed on the other side of the twin relay.

17. The twin relay according to claim 14, characterized in that the position of at least one contact spring pair is optically indicated.

* * * * *